United States Patent [19]

Seeley

[11] Patent Number: 4,538,526

[45] Date of Patent: Sep. 3, 1985

[54] TABLE FRAME ASSEMBLY

[75] Inventor: Frederic F. Seeley, St. Marys, Australia

[73] Assignee: F. F. Seeley Nominees Pty. Ltd., St. Marys, Australia

[21] Appl. No.: 479,642

[22] Filed: Mar. 28, 1983

[30] Foreign Application Priority Data

Mar. 29, 1982 [AU] Australia ..... PF3346

[51] Int. Cl.[3] ..... A42B 13/06

[52] U.S. Cl. ..... 108/127; 108/132; 108/155; 248/188.6

[58] Field of Search ..... 108/127, 166, 129, 130, 108/132, 155; 248/188.6, 188

[56] References Cited

U.S. PATENT DOCUMENTS

| | | | |
|---|---|---|---|
| 1,240,390 | 9/1917 | Uhl | 108/155 |
| 1,600,823 | 9/1926 | Hess | 108/129 |
| 1,876,447 | 9/1932 | Boenning | 108/160 |
| 2,208,704 | 7/1940 | Shannon | 108/155 |
| 2,707,664 | 5/1955 | Marsilius | 108/127 |
| 2,977,169 | 3/1961 | Geller | 108/127 |
| 4,103,626 | 8/1978 | Barricks | 108/127 |

FOREIGN PATENT DOCUMENTS

| | | | |
|---|---|---|---|
| 2250444 | 10/1972 | Fed. Rep. of Germany | 108/155 |

*Primary Examiner*—William E. Lyddane
*Assistant Examiner*—Joseph Falk
*Attorney, Agent, or Firm*—Jay L. Chaskin

[57] ABSTRACT

A table frame assembly has four frame members, four end brackets and four stay brackets, all to be secured to the under surface of a table top, the end brackets being diagonally disposed and joining the adjacent ends of the frame members, four legs, pivot means between the ends of each leg and a respective end bracket, and four articulated links interconnecting the respective legs to respective stay brackets arranged to also be secured to the under surface of the table top.

9 Claims, 5 Drawing Figures

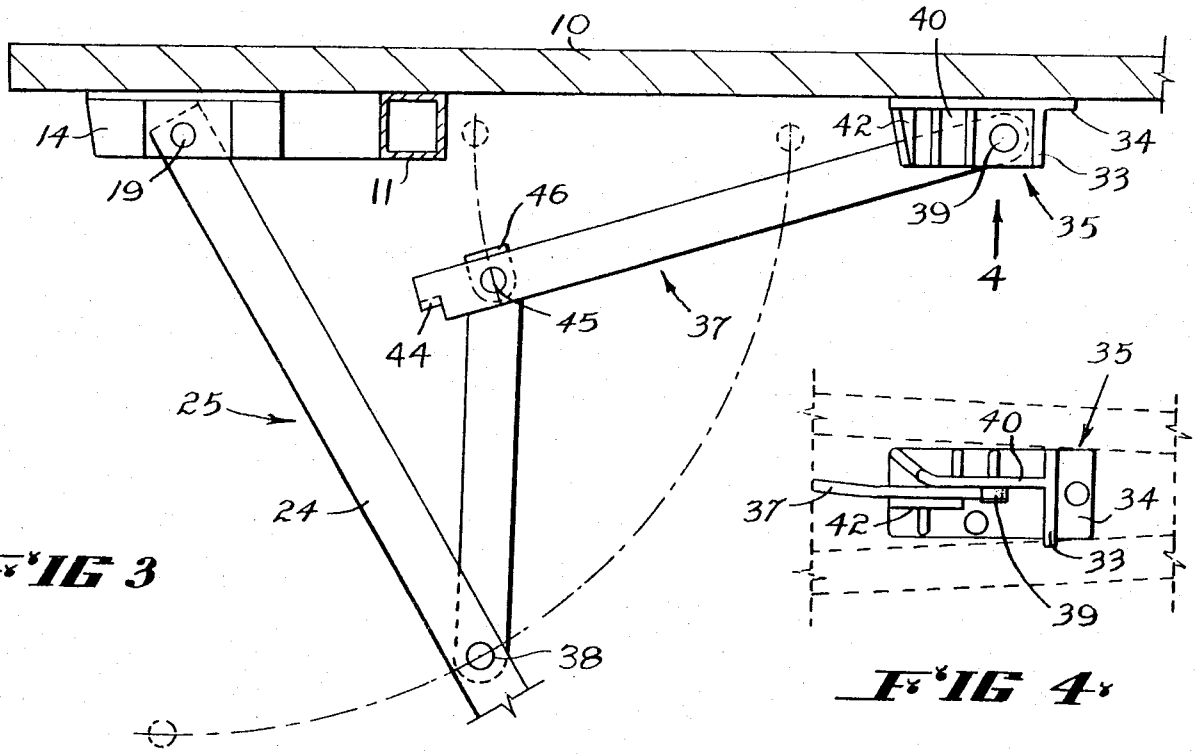
FIG 3
FIG 4
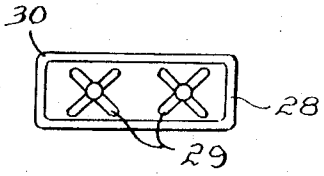
FIG 5

TABLE FRAME ASSEMBLY

This invention relates to an assembly for the supporting of a table top, the assembly incorporating a folding leg arrangement.

BACKGROUND OF THE INVENTION

With many table constructions, a table top is a substantially planar sheet which, however, is subject to buckling forces. This particularly applies when it is subject to uneven moisture penetration or uneven heating, and the main object of this invention is to provide a relatively inexpensive frame assembly which will reduce the incidence of buckling in a table top. Secondly, an object is to provide an effective and inexpensive folding leg arrangement so that the table can be folded to occupy a small space for stowing.

In a table frame in this invention a table frame assembly has four frame members, four end brackets and four stay brackets, all to be secured to the under surface of a table top, the end brackets being diagonally disposed and joining the adjacent ends of the frame members, four legs, pivot means between the ends of each leg and a respective end bracket, and four articulated links interconnecting the respective legs to respective stay brackets arranged to also be secured to the under surface of the table top.

More specifically, in this invention a table frame assembly for supporting a table top comprises four frame members in a rectangular configuration, four stay brackets, means for securing the frame members and further means for securing the stay brackets to the under surface of the table top, four end brackets each arranged diagonally with respect to the frame members, each having a pair of retaining members engaging and retaining an end of two respective frame members, and each having a hinge pin extending diagonally with respect to the frame members, four legs each hinged to a respective said end bracket by its said hinge pin and four articulated links each connected at one end to a respective said leg and at its other end to a respective said stay bracket.

With this arrangement the frame members need only be lengths of square tube containing apertures for fasteners so that they can be retained to the under surface of the table top, and if each leg comprises a pair of tubular members, they too need only be lengths of tube the lower ends of which are interconnected by feet and the upper ends contain apertures for respective hinge pins. Still further, if the stay bracket is provided with a pivot rib which is spaced from a retaining rib and the pivot rib has a protruding pivot thereon, the articulated link and its upper end can be positioned over the spigot to pivot thereon and be retained in position by the retaining rib, once there is an inclination of the articulated link with respect to the stay bracket.

BRIEF DESCRIPTION OF THE DRAWINGS

An embodiment of the invention is described hereunder in some detail with reference to, and is illustrated in, the accompanying drawings, in which FIG. 1 an underside view of a table top and frame assembly, showing one leg folded against the under surface of the table top, FIG. 4 is a fragmentary view in the direction of arrow 4, and FIG. 5 a plan view of a leg foot.

Figure 1:
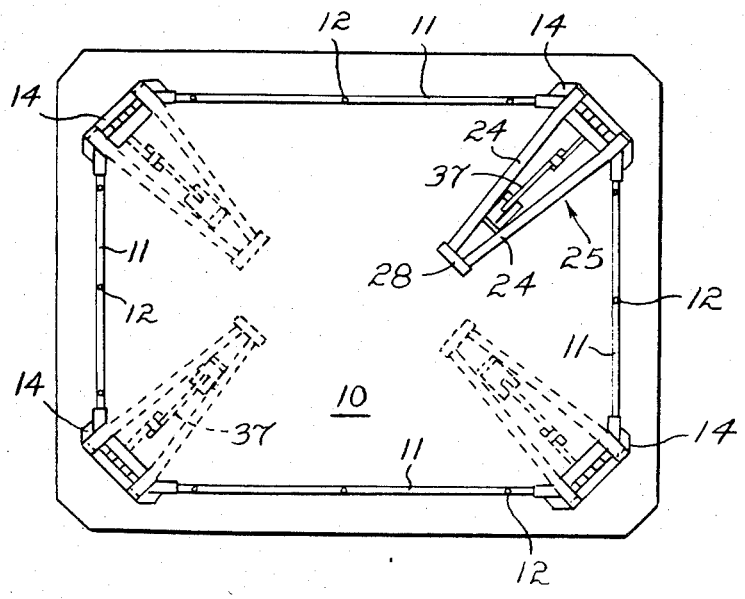
Figure 2:
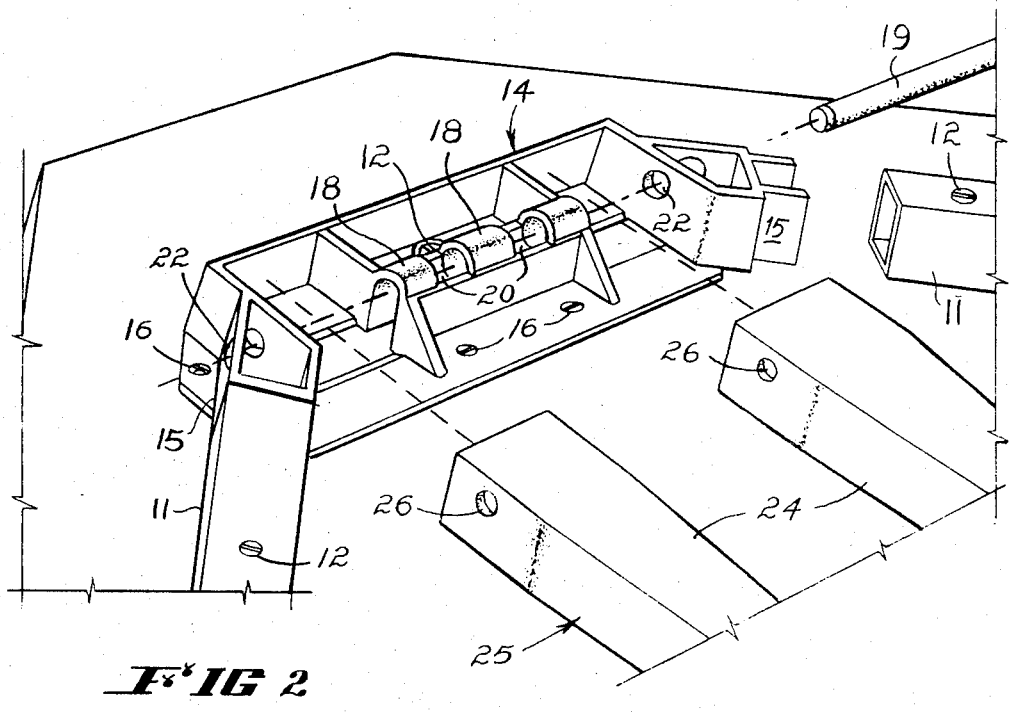
FIG. 2 is an enlarged fragmentary "exploded" perspective view, illustrating particularly an end bracket, FIG. 3 an enlarged fragmentary side elevation, illustrating particularly an articulated link and stay bracket.

In this embodiment, a table top 10 is a planar sheet of particle board wherein lignocellulose particles are retained together in a coherent mass by means of a polymeric material.

Spaced a short distance inwardly from four rectilinear edges are four corresponding frame members 11 arranged in a rectangular configuration, each frame member 11 being a square tubular frame member and being secured by means of screws 12 (or other fasteners) to the undersurface of the table top 10.

There are provided four diagonally disposed end brackets 14, each end bracket having a pair of spigots 15 which firmly engage the inner surfaces of the frame tube walls at their ends, and thereby retain assembly. The end brackets 14 are secured in position beneath the table by means of a plurality of screws 16, and this sub-assembly is found to be sufficient to greatly inhibit warping of the otherwise planar sheet.

Each end bracket 14 comprises two groups of half bearings, there being three outer half bearings 18 arranged to engage portions of the surface of a hinge pin 19 and three inner half bearings 20 arranged to engage other portions, the portions all being spaced from one another longitudinally with respect to the hinge pin 19. This provides a very simple arrangement for moulding of a bearing. The ends of the half bearings are spaced from end bearings 22 by a distance just slightly greater than the thickness of a tubular leg member, there being two tubular leg members 24 to each leg 25, the upper ends of each portion having apertures 26 extending therethrough and these apertures are engaged by respective hinge pins 19. The lower ends of the tubular leg members 24 of each leg 25 engage a foot moulding 28 (FIG. 5), the foot moulding being of polymeric material and having two upwardly directed cruciform spigots 29 which engage in the "corners" of the inner surfaces of the lower ends of the tubular leg members 24. There is also a surrounding flange 30 for aesthetic reasons.

When a leg 25 is pivoted about the hinge pin 19 to lie contiguous with the undersurface of the table top 10, the two leg members 24 engage over a wedging rib 33 (FIG. 4) which depends from the base 34 of a stay bracket 35, and this inhibits release thereby simplifying retention of the legs in position. In order to provide stability when the legs are erected to support the table top, there are provided respective stays 37, each stay comprising an articulated link. One end of the link is pivotally connected to a respective leg member 24 by a pin 38, while the other end contains a pivotal aperture which pivots about a spigot 39 which protrudes from a pivot rib 40. The pivot rib 40 defines a T-shape with the wedging rib 33.

Spaced laterally from the pivot rib 40 there is a retaining rib 42 also depending from the base 34 of the stay bracket 35, and the arrangement is such that when the articulated link is first positioned over the spigot, and then inclined with respect to the stay bracket, it is retained captive between the pivot rib 40 and the retaining rib 42. This arrangement reduces assembly time and cost. Once in its assembled condition the articulated link is always retained in position since it folds inwardly towards hinge pin 19 as shown in FIG. 3.

Outward folding of the articulated link is inhibited by a tab 44 on one link part which engages an edge of the other link part when the parts are aligned. The parts articulate about a pivot pin 45, which also hingedly supports an "L" section abutment pad 46 which, upon folding of leg 25, abuts the under surface of the table top and inhibits damage thereto.

A consideration of the above embodiment will indicate that the invention is a simple invention but nevertheless results in a stable and steady support for a table top, which said support can be folded for stowing purposes. It will be seen that, apart from the articulated links which are themselves very simple in construction, all elements are either moulded elements or merely lengths of tubing.

Various modifications in structure and/or function may be made by one skilled in the art to the disclosed embodiments without departing from the scope of the invention as defined by the claims.

What is claimed is:

1. A table frame assembly for supporting a table top, comprising four tubular frame members each of square cross-sectional shape, arranged in a rectangular configuration, four stay brackets, means for securing the frame members and further means for securing the stay brackets to the under surface of the table top, four end brackets each arranged diagonally with respect to the frame members and secured to the under surface of the table top, each having a pair of outstanding spigots receiving adjacent ends of, and retaining, two respective said frame members, each end bracket also having a hinge pin extending diagonally with respect to the frame members, four legs each hinged to a respective said end bracket by its said hinge pin, and four articulated links each connected at one end to a respective said leg and at its other end to a respective said stay bracket.

2. A table frame assembly according to claim 1 wherein each said end bracket comprises two groups of half bearings in a single moulding, one group being outer half bearings which engage respective portions of the hinge pin surface and the other group being inner half bearings which are staggered with respect to said outer half bearings, and which engage other respective portions of the hinge pin surface.

3. A table frame assembly according to claim 1 wherein each said leg comprises a pair of tubular leg members each of square cross-sectional shape which converge from a respective said end bracket to a foot, and which have apertures extending therethrough, the walls of which pivotally bear on a said hinge pin.

4. A table frame assembly according to claim 1 wherein each said stay bracket comprises a base, pivot rib and a retaining rib, a spigot outstanding from the pivot rib spaced laterally from the retaining rib, an aperture in an end of a respective articulated link, said lateral spacing between the pivot rib and the retaining rib being such that said articulated rib is positionable over the spigot and the walls of said link aperture then pivotally bear on the outstanding spigot, but upon inclining of said link, it is then held captive between the pivot rib and the retaining rib and retained on the spigot by those ribs.

5. A table frame assembly according to claim 4 wherein each said stay bracket comprises a wedging rib the ends of which engage and releasably retain the tubular leg members of a respective said leg when that leg is folded to lie adjacent the under surface of a table top.

6. A table frame assembly according to claim 1 wherein each said articulated link has two portions interconnected by a hinge pin, and an abutment pad also retained by said hinge pin and arranged to bear against the under surface of a table top when its respective leg is folded to lie adjacent the under surface of a table top.

7. A table frame assembly according to claim 4 wherein each said stay bracket comprises a base, pivot rib and a retaining rib, a spigot outstanding from the pivot rib spaced laterally from the retaining rib, an aperture in an end of a respective artiuclated link, said lateral spacing between the pivot rib and the retaining rib being such that said articulated rib is positionable over the spigot and the walls of said link aperture then pivotally bear on the outstanding spigot, but upon inclining of said link, it is then held captive between the pivot rib and the retaining rib and retained on the spigot by those ribs.

8. A table frame assembly according to claim 5 wherein each said stay brackets comprises a wedging rib the ends of which engage and releasably retain the tubular leg members of a respective said leg when that leg is folded to lie adjacent the under surface of the table top.

* * * * *